US008811863B2

(12) United States Patent
Ochi et al.

(10) Patent No.: US 8,811,863 B2
(45) Date of Patent: Aug. 19, 2014

(54) DEVELOPING DEVICE AND IMAGE FORMING APPARATUS

(75) Inventors: Takashi Ochi, Kanagawa (JP); Shota Oba, Kanagawa (JP); Shigeru Inaba, Kanagawa (JP); Shinichi Kuramoto, Kanagawa (JP); Yoshitaka Nakajima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 502 days.

(21) Appl. No.: 13/041,891

(22) Filed: Mar. 7, 2011

(65) Prior Publication Data

US 2012/0039637 A1 Feb. 16, 2012

(30) Foreign Application Priority Data

Aug. 16, 2010 (JP) ..... 2010-181598

(51) Int. Cl.
*G03G 15/09* (2006.01)

(52) U.S. Cl.
USPC ..... 399/272; 399/273; 399/277

(58) Field of Classification Search
USPC ..... 399/272, 273, 275, 277
See application file for complete search history.

(56) References Cited

U.S. PATENT DOCUMENTS

| | | | | |
|---|---|---|---|---|
| 4,213,617 | A * | 7/1980 | Salger | 399/104 |
| 4,563,978 | A * | 1/1986 | Nakamura et al. | 399/104 |
| 4,774,543 | A * | 9/1988 | Yoshikawa et al. | 399/231 |
| 5,758,240 | A * | 5/1998 | Ito et al. | 399/267 |
| 5,978,634 | A * | 11/1999 | Sato et al. | 399/277 |
| 6,317,576 | B1 | 11/2001 | Ishida et al. | |
| 2008/0205941 | A1* | 8/2008 | Sakai | 399/273 |
| 2009/0208862 | A1* | 8/2009 | Anno et al. | 430/108.7 |
| 2009/0245882 | A1* | 10/2009 | Ozeki et al. | 399/260 |
| 2009/0245887 | A1* | 10/2009 | Masuda et al. | 399/276 |
| 2009/0245889 | A1* | 10/2009 | Koetsuka et al. | 399/277 |
| 2011/0123234 | A1* | 5/2011 | Terai | 399/273 |
| 2011/0176840 | A1* | 7/2011 | Yamagishi et al. | 399/273 |
| 2011/0222919 | A1* | 9/2011 | Takemoto | 399/273 |

FOREIGN PATENT DOCUMENTS

| | | |
|---|---|---|
| JP | A-7-13424 | 1/1995 |
| JP | A-7-13435 | 1/1995 |
| JP | A 2000-214683 | 8/2000 |
| JP | A 2004-341256 | 12/2004 |
| JP | A-2007-328056 | 12/2007 |

OTHER PUBLICATIONS

Mar. 11, 2004 Office Action issued in Japanese Patent Application No. 2010-181598 (with translation).

* cited by examiner

*Primary Examiner* — David Bolduc
(74) *Attorney, Agent, or Firm* — Oliff PLC

(57) ABSTRACT

A developing device includes: a developing member including a magnetism-generating member having plural magnetic poles polarized in a circumferential-direction thereof, and a rotating member that is rotated about the magnetism-generating member; a developer-pumping pole provided in the magnetism-generating member, and that pumps up the developer, which is supplied from a developer accommodating portion, to the rotating member surface; a developer-peeling-off pole provided in the magnetism-generating member below a rotation axis of the rotating member in a vertical direction on an upstream side of the developer-pumping pole in a rotational-direction of the rotating member, that peels off the developer from the rotating member surface; and a magnetic body provided in at least a portion between a facing position facing the developer-peeling-off pole in a circumferential-direction of the rotating member and an intermediate position between the developer-peeling-off pole and the developer-pumping pole in the circumferential direction, facing the rotating member surface.

21 Claims, 6 Drawing Sheets

DEVELOPING DEVICE AND IMAGE FORMING APPARATUS

CROSS-REFERENCE TO RELATED APPLICATION

This application is based on and claims priority under 35 USC 119 from Japanese Patent Application No. 2010-181598 filed Aug. 16, 2010.

BACKGROUND

Technical Field

The present invention relates to a developing device and an image forming apparatus.

SUMMARY

According to an aspect of the invention, a developing device includes: a developing member including a magnetism generating member having plural magnetic poles polarized in a circumferential direction thereof, and a rotating member that is rotated about the magnetism generating member while holding a developer on a surface thereof, the developing member supplying a toner included in the developer to an image carrier on which an electrostatic latent image is formed to develop the electrostatic latent image; a developer pumping pole that is provided in the magnetism generating member, and that pumps up the developer, which is supplied from a developer accommodating portion accommodating the developer, to the surface of the rotating member; a developer peeling-off pole that is provided in the magnetism generating member below a rotation axis of the rotating member in a vertical direction on an upstream side of the developer pumping pole in a rotational direction of the rotating member, and that peels off the developer from the surface of the rotating member; and a magnetic body that is provided in at least a portion between a facing position facing the developer peeling-off pole in a circumferential direction of the rotating member and an intermediate position between the developer peeling-off pole and the developer pumping pole in the circumferential direction, and that faces the surface of the rotating member.

BRIEF DESCRIPTION OF THE DRAWINGS

Exemplary embodiments of the invention will be described in detail with reference to the following figures, wherein.

DETAILED DESCRIPTION

Figure 1:
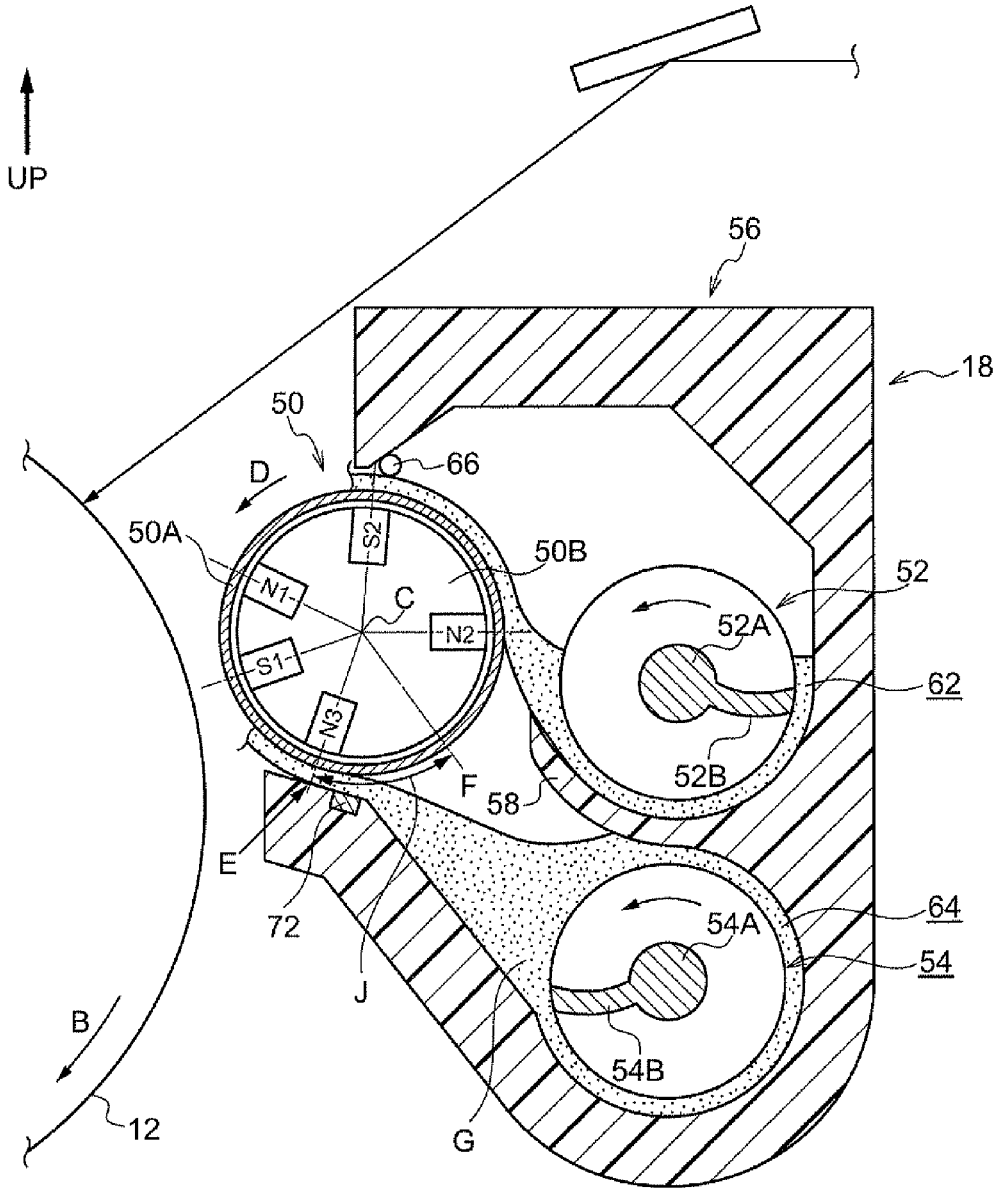
FIG. 1 is a cross-sectional view illustrating a developing device according to a first exemplary embodiment of the invention.

An example of a developing device and an image forming apparatus according to a first exemplary embodiment of the invention will be described with reference to FIGS. 1 to 5. In the drawings, an arrow UP indicates the upper side in the vertical direction.

(Overall Structure)

Figure 5:
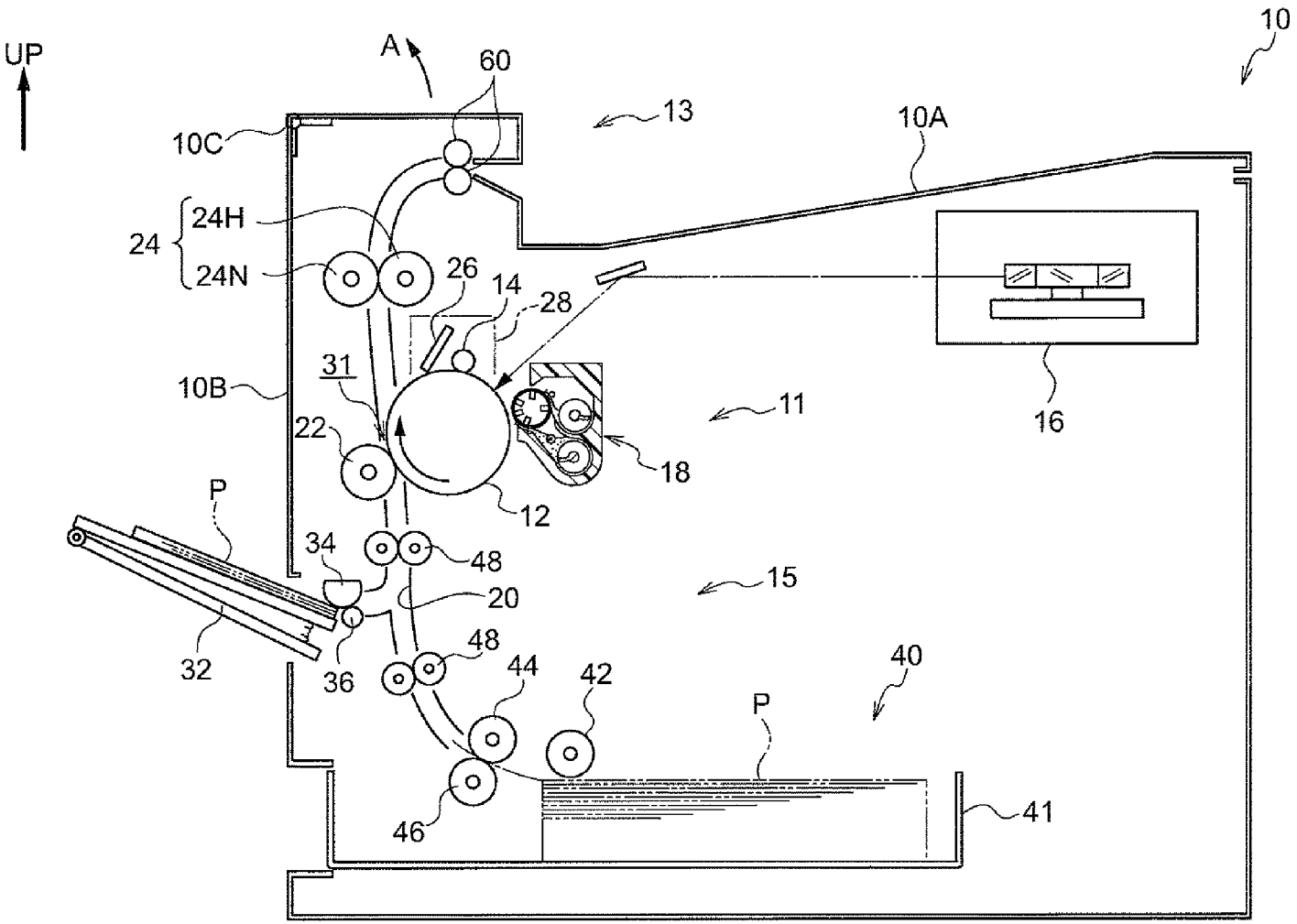
FIG. 5 is a diagram schematically illustrating the structure of an image forming apparatus according to the first exemplary embodiment of the invention.

As shown in FIG. 5, an image forming apparatus 10 includes an image processing unit 11 that forms an image, a recording medium supply unit 15 that supplies a sheet member P as a recording medium to the image processing unit 11, and a recording medium discharge unit 13 that discharges the sheet member P having an image formed thereon.

The image processing unit 11 includes an image carrier 12 on which an electrostatic latent image is formed by a laser beam after the image carrier is uniformly charged, a charging device 14 that uniformly charges the image carrier 12, an exposure device 16 that emits a laser beam to the image carrier 12 to form an electrostatic latent image on the basis of image data, a developing device 18 that selectively transfers toner to the electrostatic latent image to visualize the electrostatic latent image as a toner image, a transfer roller 22 that transfers the toner image formed on the surface of the image carrier 12 to the sheet member P supplied along a transport path 20, a fixing device 24 that heats and presses the toner image on the sheet member P and fixes the toner image to the sheet member P, and a cleaning device 26 that cleans the toner remaining on the image carrier 12 after the toner image is transferred. The developing device 18 will be described in detail below.

The image forming apparatus 10 is covered with a main body side cover 108 and a top board 10A. A shaft 10C that rotatably connects the top board 10A to the main body side cover 10B is provided at the upper corner of the main body side cover 10B. When the top board 10A is rotated about the shaft 10C in the direction of an arrow A, the image forming apparatus 10 is opened.

The charging device 14 and the cleaning device 26 are formed as one charging unit 28. When the top board 10A of the image forming apparatus 10 is opened, the charging unit 28 may be attached or removed in or from a main frame (not shown in the drawings) in the image forming apparatus 10.

A manual feed tray 32, structuring the recording medium supply unit 13, that enables the user to manually supply the sheet member P to the image forming section 31 including the image carrier 12 and the transfer roller 22 is provided on the side of the image forming apparatus 10. A semicircular transport (feeding) roller 34 is provided in the manual feed tray 32. A separating roller 36 is provided so as to face the transport roller 34 with the sheet member P interposed therebetween.

The separating roller 36 is rotatably supported by a supporting member (not shown in the drawings) provided at both ends thereof, and is urged to the transport roller 34 by the urging force of a coil spring provided in the supporting member. In this way, when the transport roller 34 is rotated, the sheet members P placed on the manual feed tray 32 are fed one by one to the image forming section 31 by the transport roller 34 and the separating roller 36.

A feeding device 40, structuring the recording medium supply unit 15 similar to the manual feed tray 32, that feeds the sheet members P one by one, is provided at a lower part of the image forming apparatus 10. The feeding device 40 includes a feed member 41 on which plural sheet members P are placed. The sheet members P placed on the feed member 41 are sequentially taken out by a takeout roller 42 and then transported one by one by the rotate-driven feed roller 44 and the separating roller 46 provided in the feed member 41.

Plural transport rollers 48 are provided along the transport path 20 of the sheet member P such that the sheet member P is transported to the downstream side (hereinafter, simply referred to as a downstream side in a transport direction) in the transport direction of the sheet member P along the transport path 20.

The above-mentioned fixing device 24 is provided on the downstream side of the image forming section 31. The fixing device 24 includes a heating roller 24H and a pressure roller 24N. When the sheet member P passes through a nip portion (contact portion) between the heating roller 24H and the pressure roller 24N, the toner image on the sheet member P is fixed to the sheet member P.

A discharge rollers 60 that discharge the sheet member P having the toner image fixed thereon to the upper surface of the top board 10A is provided on the downstream side of the fixing device 24.

In the image forming apparatus 10 having the above-mentioned structure, an image is formed as follows.

First, a voltage is applied to the charging device 14, and the charging device 14 uniformly charges the surface of the image carrier 12 to a predetermined negative potential. Then, the exposure device 16 emits light to the surface of the charged image carrier 12 to form an electrostatic latent image on the surface of the image carrier 12 on the basis of image data read by a scanner (not shown in the drawings) or external data.

That is, a laser of the exposure device 16 is turned on or off on the basis of video data supplied from a control device (not shown in the drawings), thereby forming an electrostatic latent image corresponding to image data on the image carrier 12. The electrostatic latent image is visualized as a toner image by toner supplied from the developing device 18.

Then, the sheet member P taken out from the feed member 41 by the takeout roller 42 is sent one by one to the transport rollers 48 by the feed roller 44 and the separating roller 46 and then transported to the transport path 20. The sheet member P fed out to the transport path 20 passes through the image forming section 31 formed between the image carrier 12 and the transfer roller 22 and the toner image is transferred to the sheet member P. The transferred toner image passes between the heating roller 24H and the pressure roller 24N provided at the fixing device 24 and is then fixed to the sheet member P. The sheet member P is discharged to the upper surface of the top board 10A by the discharge roller 60.

In the image forming apparatus 10 according to this exemplary embodiment, one developing device 18 is provided. However, in a case where a color image is formed, four-color (Y (yellow), M (magenta), C (cyan), and K (black)) developing devices 18 are provided at positions facing the image carrier 12.

(Main Structure)

Next, the developing device 18 will be described.

As shown in FIG. 1, the developing device 18 includes a developing roller 50, which is an example of a developing member provided so as to face the image carrier 12, a first stirring and transporting auger 52 that is disposed on the side of the developing roller 50 and supplies a binary-system developer G (hereinafter, simply referred to as a developer G) to the developing roller 50, a second stirring and transporting auger 54 that is disposed below the first stirring and transporting auger 52, and a housing 56 that accommodates the developing roller 50, the first stirring and transporting auger 52, and the second stirring and transporting auger 54. The developer G includes toner and magnetic carrier particle as a main component.

The first stirring and transporting auger 52 and the second stirring and transporting auger 54 include rotating shafts 52A and 54A, respectively, and they are rotatably supported by a peripheral wall of the housing 56 (not shown in the drawings). In addition, spiral blades 52B and 54B are formed helically at predetermined pitches in the rotating shafts 52A and 54A of the first stirring and transporting auger 52 and the second stirring and transporting auger 54, respectively.

Gears (not shown in the drawings) are fixed to the ends of the rotating shafts 52A and 54A respectively. Rotational force is transmitted from a motor (not shown in the drawings) to the gear, and the rotational force is transmitted to first stirring and transporting auger 52 and the second stirring and transporting auger 54 through the gears. When the first stirring and transporting auger 52 and the second stirring and transporting auger 54 are rotated, the developer G stored in the housing 56 is transported in the direction of the rotating shaft by the spiral blades 52B and 54B while being stirred.

Specifically, a partition wall 58 that extends from the side wall of the housing 56 toward the developing roller 50 is formed between the first stirring and transporting auger 52 and the second stirring and transporting auger 54. A first stirring path 62, which is an example of a developer accommodating portion and in which the first stirring and transporting auger 52 is arranged, and a second stirring path 64 in which the second stirring and transporting auger 54 is arranged, are formed by the partition wall 58. In addition, both ends of the partition wall 58 in the longitudinal direction are opened (not shown in the drawings), and the first stirring path 62 and the second stirring path 64 are connected to each other.

Due to this structure, the developer G is transported in the first stirring path 62 and the second stirring path 64 by the rotation of the first stirring and transporting auger 52 and the second stirring and transporting auger 54 while being stirred, and is circulated between the first stirring path 62 and the second stirring path 64.

The developing roller 50 is disposed such that a clearance (a development gap) is formed between the developing roller 50 and the image carrier 12. The developing roller 50 includes a cylindrical magnet roller 50B, which is an example of a magnetism generating member, and a rotating sleeve 50A, which is an example of a rotating member that covers the magnet roller 50B and rotates about the magnet roller 50B.

The rotating sleeve 50A is rotated about the magnet roller 50B in the direction of an arrow D (counter clockwise direction) shown in FIG. 1. That is, the rotating sleeve 50A is rotated in a direction opposite to the rotational direction of the image carrier 12 that is rotated in the direction of an arrow B (clockwise direction).

Five permanent magnets having the S pole or the N pole formed on the surface side along the circumferential direction the magnet sleeve 50A are radially provided inside the magnet roller 50B. A pole S1, which is a development pole, is arranged at a position so as to face the image carrier 12. A pick-off pole N3, which is an example of a developer peel-off (separation) pole, is arranged next to the development pole S1 along the rotational direction of the rotating sleeve 50A, and magnetic poles are arranged next to the pick-off pole N3 in the order of a pick-up pole N2, which is an example of a developer pumping pole, a trimming pole S2, and a transport pole N1. Both the development pole S1 and the trimming pole S2 are the S pole, and the pick-off pole N3, the pick-up pole N2, and the transport pole N1 are all the N pole.

Specifically, the development pole S1 generates a magnetic field having a direction for transferring the developer G supplied to the surface of the developing roller 50 to the surface of the image carrier 12. The pick-off pole N3 is arranged below the rotation axis C of the rotating sleeve 50A in the vertical direction and generates a magnetic field having a direction for separating the developer G remaining on the developing roller 50 which is not transferred to the image carrier 12 from the rotating sleeve 50A. That is, the developer G is separated from the rotating sleeve 50A by the magnetic force of the pick-off pole N3 and the magnetic force of the pick-up pole N2 cooperating, and further gravity.

The pick-up pole N2 generates a magnetic field having a direction for holding the developer G supplied from the first stirring and transporting auger 52 on the surface of the rotating sleeve 50A. The trimming pole S2 generates a magnetic field having a direction for making the developer G between the trimming pole S2 and a cylindrical layer-thickness regulating member 66, which is arranged so as to face the trimming pole S2, to direct toward the surface of the developing roller 50.

Figure 3:
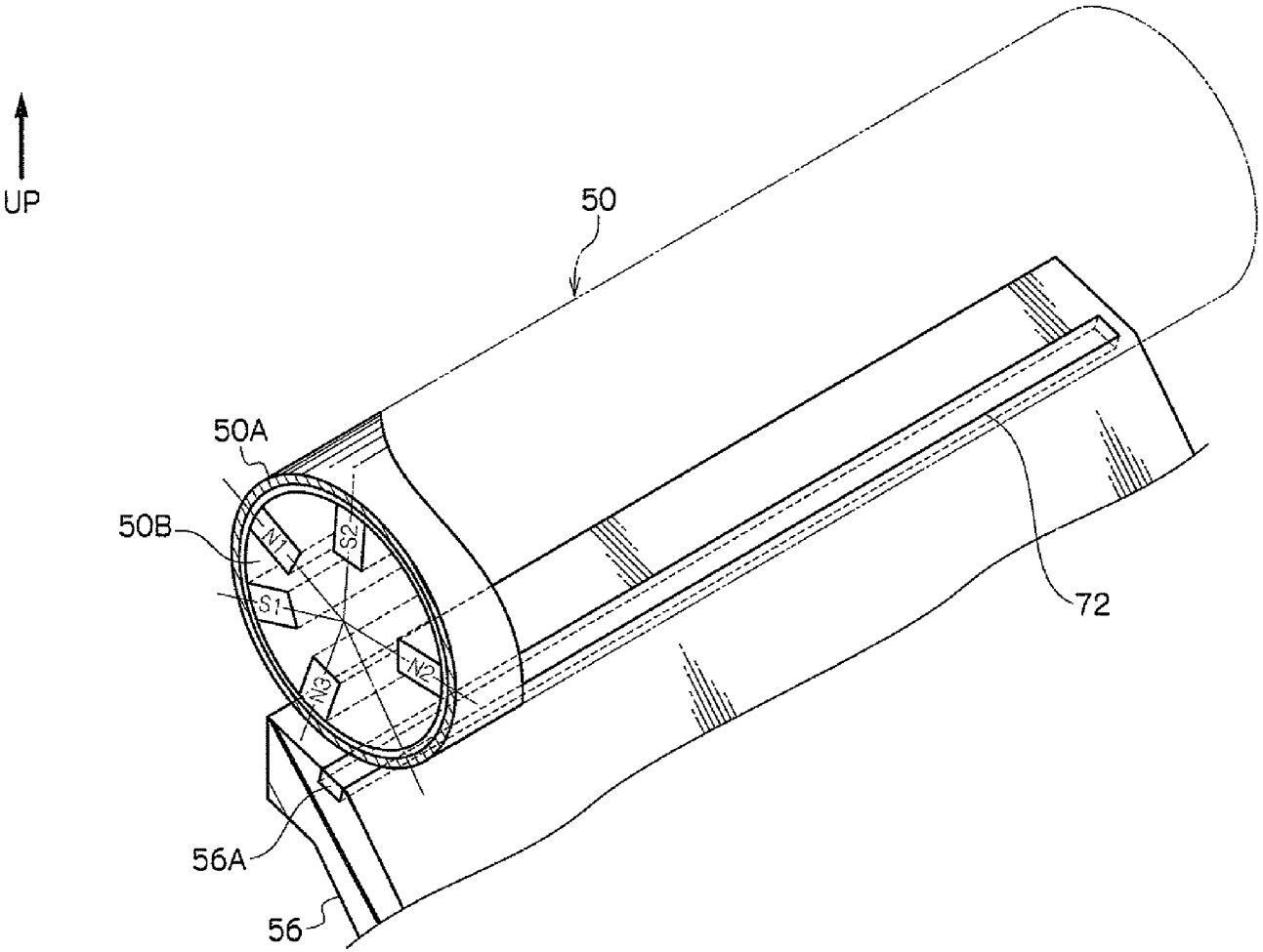
FIG. 3 is a perspective view illustrating, for example, a developing roller used in the developing device according to the first exemplary embodiment of the invention.

A magnetic body 72 (in this exemplary embodiment, magnetic SUS) is provided so as to face the surface of the rotating sleeve 50A in at least a portion between a position E and a position F in FIG. 1 (a range J in FIG. 1). The position E is a facing position E that faces the pick-off pole N3 in the circumferential direction of the rotating sleeve 50A, as viewed from the direction of the rotation axis of the rotating sleeve 50A. The position F is an intermediate position F between the pick-off pole N3 and the pick-up pole N2 in the circumferential direction of the rotating sleeve 50A (an intermediate position between a position of the peak of the magnetic flux density of the pick-off pole N3 and a position of the peak of the magnetic flux density of the pick-up pole N2), as viewed from the direction of the rotation axis of the rotating sleeve 50A. As shown in FIG. 3, the magnetic body 72 is provided (fitted) in a concave portion 56A of the housing 56 and extends in the direction of the rotation axis of the rotating sleeve 50A.

The magnetic body 72 is arranged on the downstream side of the facing position E facing the pick-off pole N3 in the rotational direction of the rotating sleeve 50A. In this way, the influence of the magnetic body 72 on the development pole S1 is less than a case in which the magnetic body 72 is arranged at the facing position E facing the pick-off pole N3.

(Operation)

Next, the operation of the developing device 18 will be described.

As shown in FIG. 1, the developer G is transported inside the first stirring path 62 and the second stirring path 64 by the rotation of the first stirring and transporting auger 52 and the second stirring and transporting auger 54 while being stirred, and is circulated between the first stirring path 62 and the second stirring path 64.

When the rotating sleeve 50A is rotated in the rotational direction D, first, the developer G stirred by the first stirring and transporting auger 52 and the second stirring and transporting auger 54 is attracted from the first stirring and transporting auger 52 to the surface of the rotating sleeve 50A by the pick-up pole N2.

The magnetic field from the transport pole N1 toward the development pole S1, the magnetic field from the pick-off pole N3 toward the development pole S1, the magnetic field from the pick-up pole N2 toward the trimming pole S2, and the magnetic field from the transport pole N1 toward the trimming pole S2 are formed on the surface of the rotating sleeve 50A.

Figure 4:
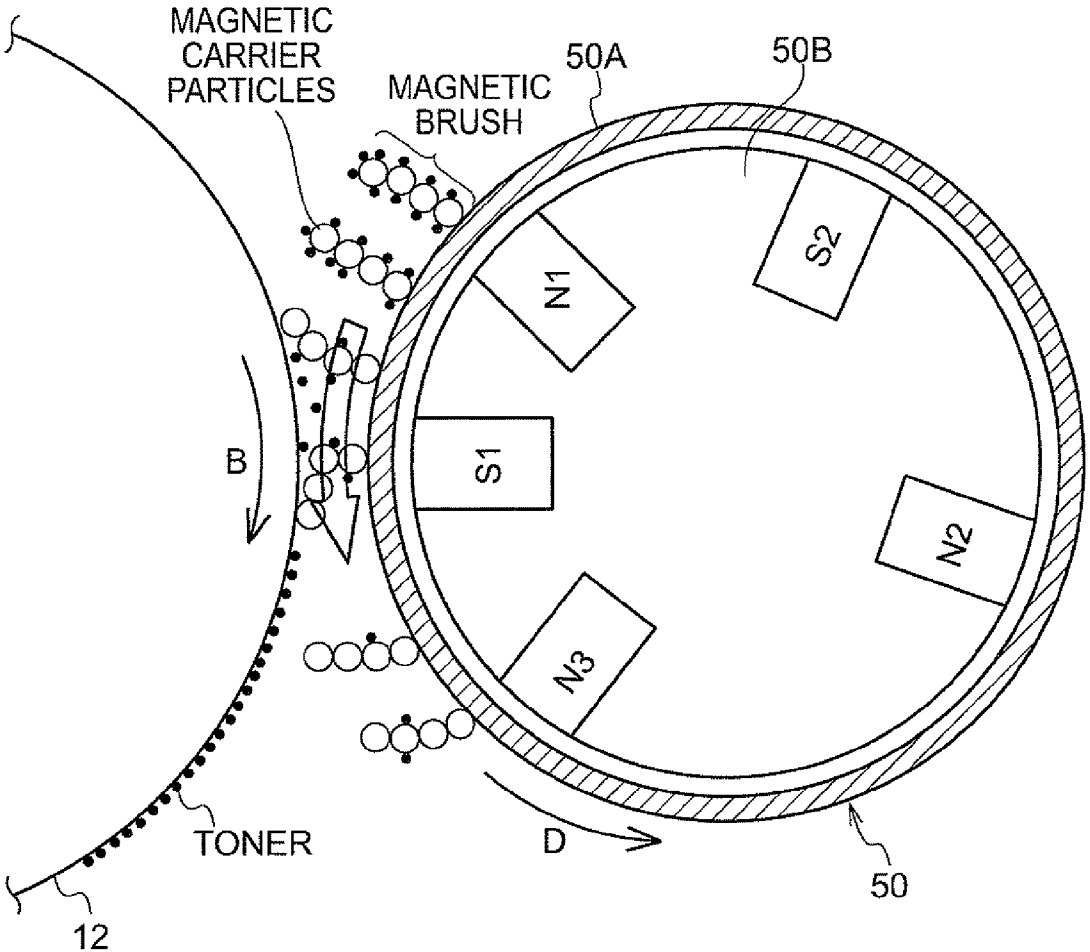
FIG. 4 is a side view illustrating the developing roller and an image carrier used in the developing device according to the first exemplary embodiment of the invention.

In this way, as shown in FIG. 4, the developer G attracted to the surface of the rotating sleeve 50A is arranged in the direction of the line of magnetic force on the surface of the rotating sleeve 50A and a magnetic brush in ear-standing state is formed.

With the rotation of the rotating sleeve 50A in the rotational direction, the magnetic brush of the developer G formed on the surface of the rotating sleeve 50A in the vicinity of the pick-up pole N2 is transported in the counterclockwise direction in FIG. 4, that is, in the direction of the trimming pole S2→the transport pole N1→the development pole S1→the pick-off pole N3.

In the vicinity of the trimming pole S2, the developer G supplied onto the rotating sleeve 50A bits the layer-thickness regulating member 66 and the thickness of the layer of the developer G is regulated (see FIG. 1).

In the vicinity of the development pole S1, the toner on the magnetic brush is transferred to the image carrier 12 and a magnetic brush including substantially only the magnetic carriers (the developer G whose toner density is reduced) remains on the surface of the rotating sleeve 50A. With the rotation of the rotating sleeve 50A, the magnetic brush whose toner density is lowered (small) comes off from the rotating sleeve 50A by the pick-off pole N3 and is separated from the surface of the rotating sleeve 50A by gravity.

Figure 2:
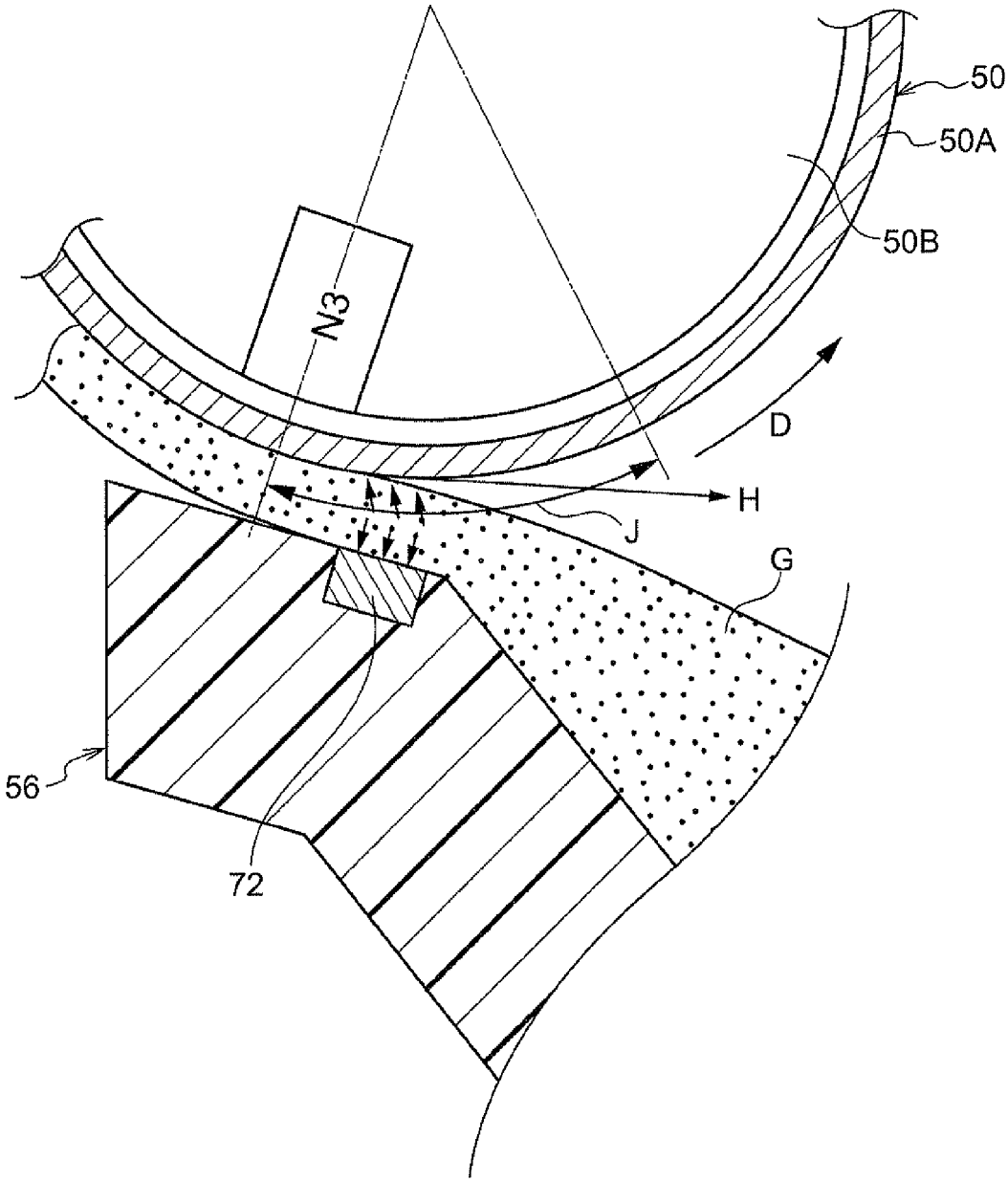
FIG. 2 is an enlarged cross-sectional view illustrating the developing device according to the first exemplary embodiment of the invention.

As shown in FIGS. 1 and 2, in a case where the rotating sleeve 50A is rotated at a high speed, it is considered that the developer G separated from the rotating sleeve 50A is scattered to a region where it receives the attraction force of the pick-up pole N2 (see FIG. 1) in the tangential direction (a direction H in FIG. 2) of the rotating sleeve 50A by inertial force received from the rotating sleeve 50A and is then attracted to the rotating sleeve 50A again.

However, the magnetic body 72 that is arranged so as to face the surface of the rotating sleeve 50A in the above-mentioned range J is magnetized by influence of the pick-off pole N3. Accordingly, the magnetic carriers included in the developer G are attracted to the pick-off pole N3 and the magnetic body 72 (a magnetic field is formed between the pick-off pole N3 and the magnetic body 72 and permeability is increased).

Here, the magnetic carriers are attracted to the pick-off pole N3 and the magnetic body 72, so the developer G stays and remains (is in congested state) between the pick-off pole N3 and the magnetic body 72. Therefore, the transport speed of the developer G becomes lower than the circumferential speed of the rotating sleeve 50A. In this way, the scatter-speed of the developer G separated from the rotating sleeve 50A is reduced and the developer G is not scattered to the region where it receives the attraction force of the pick-up pole N2 (see FIG. 1).

Therefore, the developer G whose toner density is reduced is prevented (suppressed) from being adhered to the rotating sleeve 50A again. In this way, the electrostatic latent image formed on the surface of the image carrier 12 is visualized as a toner image by the developer G with appropriate toner density.

Figure 6:
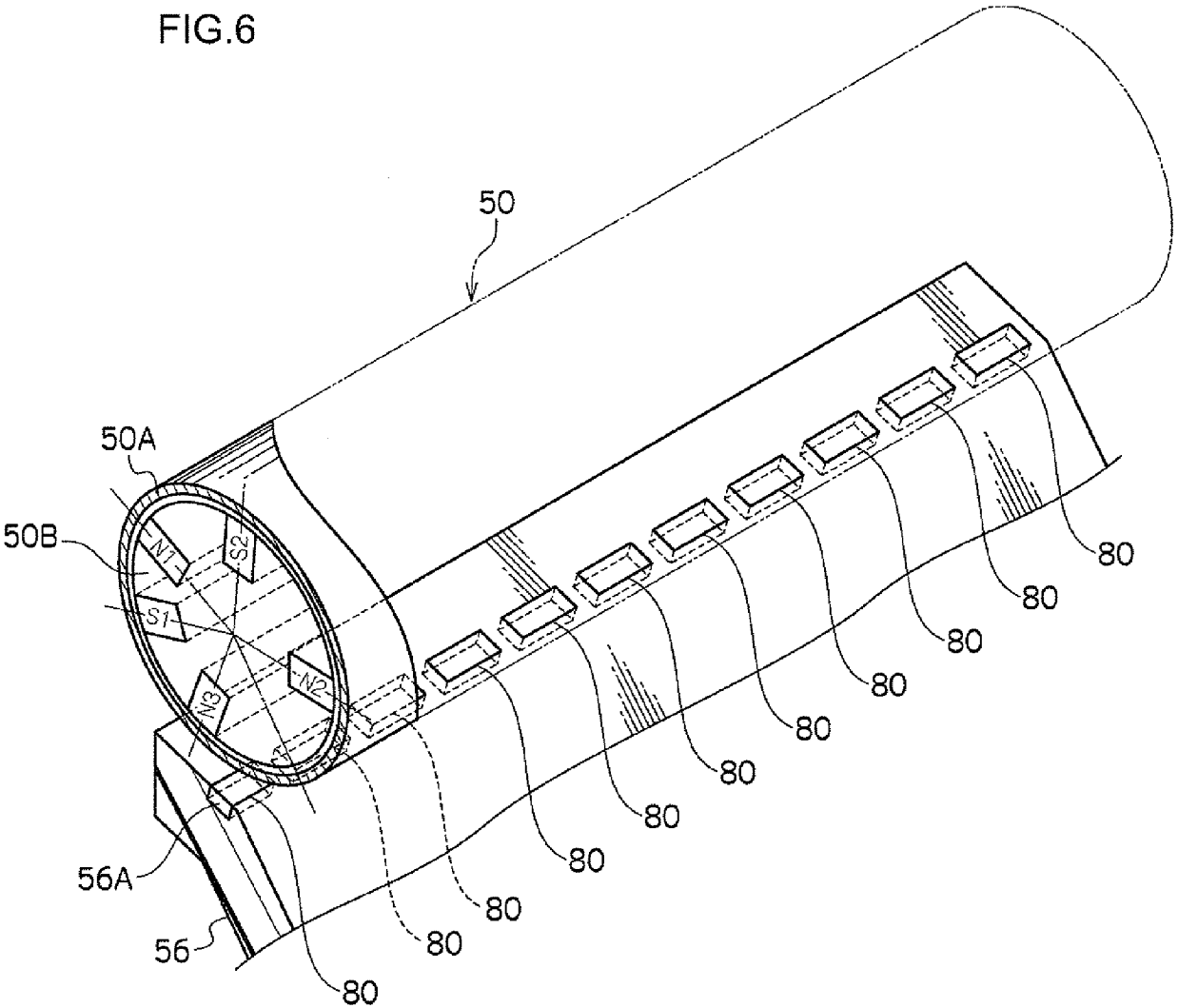
FIG. 6 is a perspective view illustrating, for example, a developing roller used in the developing device according to a second exemplary embodiment of the invention.

Next, an example of a developing device and an image forming apparatus according to a second exemplary embodiment of the invention will be described with reference to FIG. 6. The same members as those in the first exemplary embodiment are denoted by the same reference numerals and a description thereof will be omitted.

In the second exemplary embodiment, plural magnetic bodies 80 are provided in a line along the direction of the rotation axis of the rotating sleeve 50A, unlike the first exemplary embodiment. That is, the plural same components are arranged.

The exemplary embodiments of the invention have been described in detail above, but the invention is not limited to the exemplary embodiments. It will be understood by those skilled in the art that various kinds of exemplary embodiments may be made within the scope of the invention. For example, in the above-described exemplary embodiments, although not particularly described, the magnetic body 72 may be coated, and it may be enough that the magnetic body generates magnetic force to attract the magnetic carriers.

In the above-described exemplary embodiments, SUS (stainless steel) is used as the magnetic bodies 72 and 80. However, the material forming the magnetic body is not particularly limited to SUS, but the magnetic bodies 72 and 80 may be magnets or other magnetic bodies such as iron.

In the above-described exemplary embodiments, the magnetic bodies 72 and 80 are arranged on the downstream side of the facing position E facing the pick-off pole N3 in the rotational direction of the rotating sleeve 50A. However, the magnetic bodies may be arranged at the facing position E.

In the above-described exemplary embodiments, no magnet is arranged between the pick-off pole N3 and the pick-up pole N2, and the pick-off pole N3 and the pick-up pole N2 are the same pole. However, a magnet may be arranged between the pick-off pole N3 and the pick-up pole N2. In this case, the pick-off pole N3 and the pick-up pole N2 may be different poles.

What is claimed is:

1. A developing device comprising:

a developing member including a magnetism generating member having a plurality of magnetic poles polarized in a circumferential direction thereof, and a rotating member that is rotated about the magnetism generating member while holding a developer on a surface thereof, the developing member supplying a toner included in the developer to an image carrier on which an electrostatic latent image is formed to develop the electrostatic latent image;

a developer pumping pole that is provided in the magnetism generating member, and that pumps up the developer, which is supplied from a developer accommodating portion accommodating the developer, to the surface of the rotating member;

a developer peeling-off pole that is provided in the magnetism generating member below a rotation axis of the rotating member in a vertical direction on an upstream side of the developer pumping pole in a rotational direction of the rotating member, and that peels off the developer from the surface of the rotating member; and a magnetic body comprising one of a magnet or a member that is magnetized by the developer peeling-off pole, wherein the magnetic body is arranged relative to the developer peeling-off pole so as to form an attractive magnetic field between the magnetic body and the developer peeling-off pole, and wherein the magnetic body is completely and directly provided between a facing position facing the developer peeling-off pole in a circumferential direction of the rotating member and a facing position facing the developer pumping pole in the circumferential direction, and that faces the surface of the rotating member.

2. The developing device of claim 1, wherein the magnetic body is arranged on the downstream side of the facing position in the rotational direction of the rotating member.

3. The developing device of claim 1, wherein the magnetic body is arranged at the facing position.

4. The developing device of claim 1, wherein the magnetic body is provided to extend in a direction of the rotation axis of the rotating member.

5. The developing device of claim 1, wherein a plurality of the magnetic bodies are provided along a direction of the rotation axis of the rotating member.

6. The developing device of claim 1, wherein the magnetic body is provided at a casing that accommodates the developing member and the developer accommodating portion.

7. An image forming apparatus comprising:

an image carrier on which an electrostatic latent image is formed; and a developing device including:

a developing member including a magnetism generating member having a plurality of magnetic poles polarized in a circumferential direction thereof and a rotating member that is rotated about the magnetism generating member while holding a developer on a surface thereof, the developing member supplying a toner included in the developer to the image carrier on which the electrostatic latent image is formed to develop the electrostatic latent image;

a developer pumping pole that is provided in the magnetism generating member, and that pumps up the developer, which is supplied from a developer accommodating portion accommodating the developer, to the surface of the rotating member;

a developer peeling-off pole that is provided in the magnetism generating member below a rotation axis of the rotating member in a vertical direction on an upstream side of the developer pumping pole in a rotational direction of the rotating member, and that peels off the developer from the surface of the rotating member; and a magnetic body comprising one of a magnet or a member that is magnetized by the developer peeling-off pole, wherein the magnetic body is arranged relative to the developer peeling-off pole so as to form an attractive magnetic field between the magnetic body and the developer peeling-off pole, and wherein the magnetic body is completely and directly provided between a facing position facing the developer peeling-off pole in a circumferential direction of the rotating member and a facing position facing the developer pumping pole in the circumferential direction, and that faces the surface of the rotating member.

8. The image forming apparatus of claim 7, wherein the magnetic body is arranged on the downstream side of the facing position in the rotational direction of the rotating member.

9. The image forming apparatus of claim 7, wherein the magnetic body is arranged at the facing position.

10. The image forming apparatus of claim 7, wherein the magnetic body is provided to extend in a direction of the rotation axis of the rotating member.

11. The image forming apparatus of claim 7, wherein a plurality of the magnetic bodies are provided along a direction of the rotation axis of the rotating member.

12. The image forming apparatus of claim 7, wherein the magnetic body is provided at a casing that accommodates the developing member and the developer accommodating portion.

13. The developing device of claim 1, further comprising a housing, wherein the magnetic body is provided in at least a portion of the housing that is proximate to the image carrier.

14. The developing device of claim 1, further comprising a housing, wherein the developer peeling-off pole is proximate to a portion of the housing that is proximate to the image carrier so that the developer peeling-off pole peels off the developer from the surface of the rotating member at the portion of the housing that is proximate to the image carrier.

15. The image forming apparatus of claim 7, wherein the developing device further includes a housing, wherein the magnetic body is provided in at least a portion of the housing that is proximate to the image carrier.

16. The image forming apparatus of claim 7, wherein the developing device further includes a housing, wherein the developer peeling-off pole is proximate to a portion of the housing that is proximate to the image carrier so that the developer peeling-off pole peels off the developer from the surface of the rotating member at the portion of the housing that is proximate to the image carrier.

17. The developing device of claim 1, wherein one of the plurality of magnetic poles comprises a S-pole magnetic member closest in proximity to the image carrier and facing the image carrier.

18. The developing device of claim 1, wherein one of the plurality of magnetic poles comprises an S-pole magnetic member that comprises an outward face facing in a direction that is normal to the rotational axis and facing the image carrier.

19. The developing device of claim 1, wherein the developer peeling-off pole is proximate to an opening of the housing that is proximate to the image carrier and is downstream from the image carrier.

20. The developing device of claim 1, wherein the magnetic body is disposed proximate to an opening of the housing that receives the developer that is peeled off from the surface of the rotating member and that is proximate to the image carrier.

21. The developing device of claim 1, wherein the magnetic body is disposed closer to the developer peeling-off pole than the developer pumping pole.

* * * * *